US010154557B2

(12) United States Patent
Hwang et al.

(10) Patent No.: US 10,154,557 B2
(45) Date of Patent: Dec. 11, 2018

(54) LIGHT-EMITTING DIODE DRIVER DEVICE HAVING A MULTI-STAGE DRIVER MODULE AND METHOD FOR DRIVING THE SAME

(71) Applicant: JITBoundary United Production Inc., Taichung (TW)

(72) Inventors: Ying-Diean Hwang, Taichung (TW); Po-Wen Ko, Taichung (TW)

(73) Assignee: JITBoundary United Production Inc., Taichung (TW)

( * ) Notice: Subject to any disclaimer, the term of this patent is extended or adjusted under 35 U.S.C. 154(b) by 0 days.

(21) Appl. No.: 15/858,613

(22) Filed: Dec. 29, 2017

(65) Prior Publication Data

US 2018/0192492 A1 Jul. 5, 2018

(30) Foreign Application Priority Data

Jan. 5, 2017 (TW) ..... 106100341 A

(51) Int. Cl.
*H05B 33/08* (2006.01)
*H05B 37/02* (2006.01)

(52) U.S. Cl.
CPC ..... *H05B 33/0845* (2013.01); *H05B 33/0821* (2013.01); *H05B 37/02* (2013.01); *H05B 37/029* (2013.01)

(58) Field of Classification Search
None
See application file for complete search history.

(56) References Cited

U.S. PATENT DOCUMENTS 7,138,770 B2 * 11/2006 Uang ..... H05B 33/0803 315/291
2008/0211421 A1 * 9/2008 Lee ..... H05B 33/0806 315/250
2011/0156602 A1 6/2011 Liang et al.
2011/0273099 A1 11/2011 Liang et al.
2013/0285568 A1 * 10/2013 Takeda ..... H05B 33/0824 315/193

(Continued)

FOREIGN PATENT DOCUMENTS

TW 201105172 2/2011
TW I449458 8/2014

(Continued)

*Primary Examiner* — Jany Richardson
(74) *Attorney, Agent, or Firm* — Jackson IPG PLLC; Demian K. Jackson

(57) ABSTRACT

The present invention involves use of at least two unidirectional elements to provide flow paths for the positive half cycle and the negative half cycle of the AC power input, respectively, and the at least two LED modules are integrated in the flow path of the positive half cycle and the negative half cycle, respectively, and a multi-stage driver module is integrated, so that when the positive half cycle or the negative half cycle is conducting, the at least two LED modules are lit up in different alternating orders, thereby rendering the light emission of the at least two LED modules substantially identical in an AC power cycle in terms of power and brightness. The invention overcomes the problem of uneven brightness of the LED lighting apparatus using a conventional multi-stage driver device.

12 Claims, 8 Drawing Sheets

(56) References Cited

U.S. PATENT DOCUMENTS

| | | | | |
|---|---|---|---|---|
| 2015/0237696 | A1* | 8/2015 | Shackle | H05B 33/0821 315/188 |
| 2015/0373794 | A1* | 12/2015 | Li | H05B 33/0809 315/200 R |

FOREIGN PATENT DOCUMENTS

| | | |
|---|---|---|
| TW | M532705 | 11/2016 |
| WO | 2011010774 | 1/2011 |

* cited by examiner

LIGHT-EMITTING DIODE DRIVER DEVICE HAVING A MULTI-STAGE DRIVER MODULE AND METHOD FOR DRIVING THE SAME

PRIORITY CLAIM

This application claims priority to R.O.C. Patent Application No. 106100341 filed Jan. 5, 2017, the entirety of which is incorporated herein by reference.

BACKGROUND OF THE INVENTION

1. Field of the Invention

The present invention relates to a light-emitting diode (LED) driver device and a method for driving LEDs. More particularly, the invention involves reducing the difference in brightness among LED modules and solving the problem of uneven brightness with a simple circuitry architecture.

2. Description of the Related Art

Light-emitting diode (abbreviated hereafter as LED) is a luminous semiconductor electronic element. This electronic element emerged as early as 1962. In the early days, only low-intensity red light could be emitted, and later on other monochromatic light were developed. Up to now, the light that can be emitted from LEDs has extended to visible light, infrared light and ultraviolet light, and the luminance has also been raised to a relatively high level. Initially, LEDs were only used in indicator lights and display panels, etc. With the emergence of white light-emitting diodes, the applications of LEDs to a variety of lighting devices have become increasingly widespread. For example, high-brightness LEDs have been widely used in traffic lights, vehicle indicator lights, and brake lights. In recent years, lighting devices provided with high-voltage LED light bars have been developed to replace conventional incandescent light bulbs and fluorescent light bulbs.

Light-emitting diode needs to be driven by DC power to light up. Therefore, when an LED is incorporated into a lighting device or an indicator device which receives AC power, additional power transformation circuits are needed to convert the AC power to a DC power adapted to light the LED up. The LED drivers commonly seen in the recent lighting market can be generally divided into (1) switch type drivers, (2) resistance capacitance drivers, (3) multi-stage linear drivers and (4) constant current drivers. The switch-type drivers are complicated in configuration and the lifespan thereof is unsatisfactorily short, and costly light modulating circuits would have to be additionally incorporated thereinto to thereby provide light modulation function. The resistance capacitance drivers are unstable in voltage and current output, and the constant current drivers have a drawback of low operation efficiency.

FIG. 1 shows a conventional LED lighting unit provided with a multi-stage linear driver. Several LED lamps are arranged in series downstream of a bridge rectifier 110 and grouped into two segments, namely the first LED segment 121 and the second LED segment 122, connected to the input terminals DR1, DR2 of the multi-stage linear driver IC 140, respectively. Referring to FIG. 2, in an AC power cycle, as the input voltage 210 increases, the two LED segments 121 and 122 will be conducted sequentially and lit up one after another. When the input voltage 210 is at a low level, the power is supplied through the input terminal DR1 to the multi-stage linear driver IC 140, and the input terminal DR1 is in the conducted state. When the input voltage 210 is increased to the lighting voltage of the first LED segment 121, the first LED segment 121 is conducted and lit up at this moment and the input terminal DR1 starts to operate, so that the LED current I1 flows through the input terminal DR1. When the input voltage 210 continues to increase until the voltage drop at the input terminal DR1 relative to the input terminal DR2 reaches the lighting voltage of the second LED segment 122, the first LED segment 121 and the second LED segment 122 are conducted and lit up, so that the LED current I2 flows through the input terminal DR2, and the input terminal DR1 is shut off. Conversely, as the input voltage 210 is gradually decreased to a level below the lighting voltages of the respective LED segments, the second LED segment 122 and the first LED segment 121 will stop operating successively. Therefore, the use of multi-stage linear driver may also have light modulation effect in the absence of an additional light modulating loop.

It can be seen from FIG. 2 that in the conducting paths of the positive half cycle and negative half cycle of an AC input signal, with increasing in the input voltage 210, during the process of the two LED segments 121, 122 conducted and lit up one after another (always the first LED segment 121 lit up first and then the second LED segment 122 lit up), the two LED segments 121, 122 are often lit up at different times and the powers received are often different as well. This will cause the problem that the two LED segments 121, 122 emit different amounts of light, thereby leading to the problem of unevenness brightness between these two LED segments. In order to solve this problem, it was proposed in WO 2011/010774 A1 that all of the LEDs be arranged in a complicated manner disclosed therein, so that the LEDs in different LED segments are evenly distributed to avoid the difference in brightness owing to the different power cycles occurring in different segments. However, this design not only increases the complexity of the LED lamps design, but also needs to work out under the condition that the LED lamp bars include a large number of LED units.

Moreover, the operation of the respective LEDs varies with the regular fluctuation of the sinusoidal wave of a power cycle, namely, the light intensities emitted from the respective LEDs show a rapid and repeated variation, resulting in unstable light emission which is called flicker. This phenomenon of flicker, irrespective of whether human eyes can recognize or not, can affect human body to a varying degree, such as headache, giddiness, eyestrain, nervousness or epilepsy.

Conventional driving circuit designs tend to increase capacitance to adjust the rectified AC voltage output, so that a DC voltage with less fluctuation may be obtained to achieve the purpose of voltage stabilization, thereby minimizing the flicker phenomenon. However, the LED lighting apparatus equipped with a multi-stage linear driver as described above is not suitable for increasing the setting of capacitance. The reasons are that:

1. In the case where the capacitor is set in the first LED segment 121, the AC current drives the LEDs and also charges the capacitor during the charging phase. During the discharging phase, the capacitor supplies current to the LEDs. In this case, although the flicker problem of the first LED segment 121 is improved and the luminous efficiency thereof is promoted, the difference in the electric current received by the first and second LED segments 121, 122 increases, making the problem of uneven brightness more serious.

2. In the case where the two LED segments 121 and 122 are connected in parallel with a capacitor, the input voltage can be kept at the lighting voltage of the second LED segment 122, where the first LED segment 121 and the second LED segment 122 are conducting and lit up. However, the effect of multi-stage driving is lost in this case.

3. In the case where the capacitor is connected across the rectifier output terminal, although the rectified AC output voltage can be adjusted to obtain a DC voltage with less fluctuation, the sharp increase of AC current and linearity decrease as well as high harmonic distortion in the waveform may also lead to low power factor of the LED lighting apparatus. Moreover, the withstand voltage value of the capacitor must be higher than the input voltage. For example, if the input voltage is 110 volts, the capacitor must use a high-voltage capacitor (with a withstand voltage of 150 volts). However, using a high-voltage capacitor increases the manufacturing cost and size of the apparatus.

Therefore, there is a need for a light-emitting diode driver device having a relatively simple circuit architecture, which makes each LED segment have substantially the same power and provide the same amount of light emission in one AC power cycle, thereby substantially diminishing flickering and uneven brightness. The device disclosed herein can further improve the flicker phenomenon and does not affect the power factor of the LED driving circuit, thereby making the AC LED device more suitable for use in the lighting applications.

SUMMARY OF INVENTION

In the first aspect provided herein is a light-emitting diode (LED) driver device, which can reduce the difference in brightness among LED modules and solve the problem of uneven brightness with a simple circuit structure.

In the second aspect provided herein is a method for driving LEDs.

The present invention involves use of at least two unidirectional elements to provide flow paths for the positive half cycle and the negative half cycle of the AC power input, respectively, and the at least two LED modules are integrated in the flow path of the positive half cycle and the negative half cycle, respectively, and a multi-stage driver module is integrated, so that when the positive half cycle or the negative half cycle is conducting, the at least two LED modules are lit up in different alternating orders, thereby rendering the light emission of the at least two LED modules substantially identical in an AC power cycle in terms of power and brightness. The invention overcomes the problem of uneven brightness of the LED lighting apparatus using a conventional multi-stage driver device.

The light-emitting diode driver device comprises a rectifier circuit comprising a first and a second AC input terminals and a first and a second rectification output terminals. The first and second AC input terminals are adapted to receive AC input power. The rectification circuit comprises a first, a second, a third and a fourth unidirectional elements, each comprising a positive electrode and a negative electrode. The positive electrode of the first unidirectional element is connected to the first AC input terminal, while the positive electrode of the third unidirectional element is connected to the second AC input terminal. The negative electrodes of the first and the fourth unidirectional elements are connected to the second rectification output terminal. The negative electrodes of the second and the third unidirectional elements are connected to the first rectification output terminal. A first LED module is coupled between the negative electrode of the first unidirectional element and the positive electrode of the second unidirectional element, while a second LED module is coupled between the negative electrode of the third unidirectional element and the positive electrode of the fourth unidirectional element. A multi-stage driver module is coupled between the positive electrode of the second unidirectional element and the positive electrode of the fourth unidirectional element.

In a preferred embodiment, the multi-stage driver module is selected from the group consisting of a multi-stage driving unit and a current limiting unit.

In a preferred embodiment, the LED driver device further comprises at least one additional LED module and at least one additional unidirectional element.

In a preferred embodiment, the first LED module is further connected in parallel with a first capacitor unit, and the second LED module is further connected in parallel with a second capacitor unit.

In a preferred embodiment, the at least one additional LED module is connected in parallel with an additional capacitor unit.

In a preferred embodiment, the capacitor units each has a withstand voltage value of less than 100 volts.

DETAILED DESCRIPTION OF THE INVENTION

The present invention involves providing a flow path for a positive half cycle of AC power input and a flow path for a negative half cycle of the AC power input by using at least two unidirectional elements, respectively; integrating at least two LED modules into the flow paths of the positive half cycle and the negative half cycle, respectively; and integrating a multi-stage driver module, so that when the positive half cycle is conducted, the at least two LED modules are lit up in a different alternating order from the alternating order when the negative half cycle is conducted.

Figure 3:
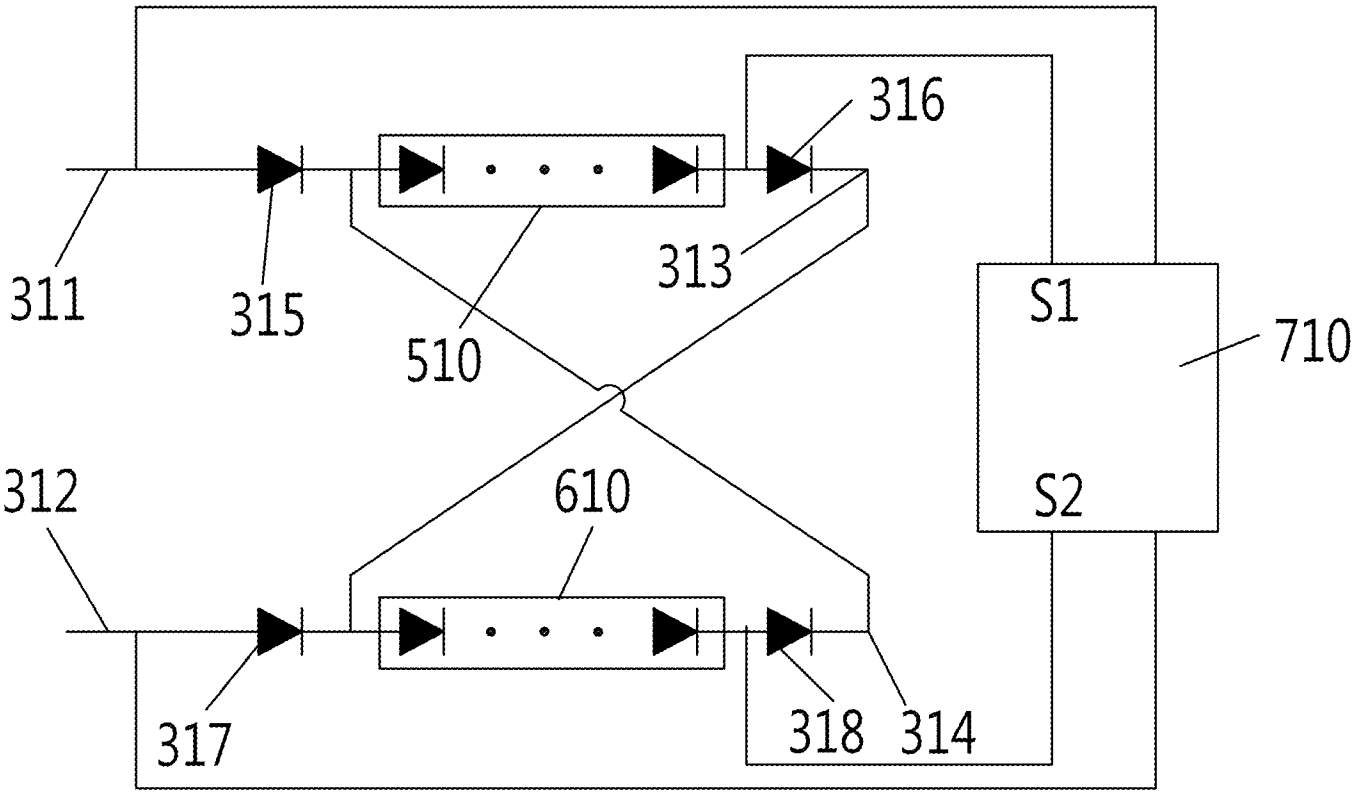
FIG. 3 shows a first schematic diagram of the LED driver device according to the invention.

According to the first embodiment shown in FIG. 3, the method disclosed herein is performed by a driver device, which comprises at least a rectifier circuit, a first LED module 510, a second LED module 610, and a multi-stage driver module 710.

The rectifier circuit includes a first and a second AC input terminal 311, 312 and a first and a second rectification output terminal 313, 314. The first and the second AC input terminal 311, 312 are adapted for receiving an AC input power, so that the AC input power may be rectified to a DC power. The rectifier circuit includes at least four unidirectional elements, i.e., a first, a second, a third and a fourth unidirectional element 315, 316, 317 and 318, each comprising a positive electrode and a negative electrode. The positive electrodes of the first and the third unidirectional elements 315, 317 are connected to the first and the second AC input terminals 311, 312, respectively. The negative electrodes of the first and the fourth unidirectional elements 315, 318 are connected to the second rectification output terminal 314. The negative electrodes of the second and the third unidirectional elements 316, 317 are connected to the first rectification output terminal 313. In a preferred embodiment, the unidirectional elements described above may be a rectifying diode or a light-emitting diode.

The first LED module 510 is coupled between the negative electrode of the first unidirectional element 315 and the positive electrode of the second unidirectional element 316. The first LED module 510 may comprise either a single LED unit or a plurality of LED units connected in series as shown in FIG. 3.

The second LED module 610 is coupled between the negative electrode of the third unidirectional element 317 and the positive electrode of the fourth unidirectional element 318. The second LED module 610 comprises either a single LED unit or a plurality of LED units connected in series as shown in FIG. 3.

The multi-stage driver module 710 is coupled between the positive electrode of the second unidirectional element 316 and the positive electrode of the fourth unidirectional element 318. In a preferred embodiment, the multi-stage driver module 710 may be selected from a group consisting of a multi-stage driving unit and a current limiting unit. In a preferred embodiment, the multi-stage driver module 710 is provided with a first and a second input terminals S1, S2. The first input terminal S1 is coupled between the first LED module 510 and the positive electrode of the second unidirectional element 316, while the second input terminal S2 is coupled between the second LED module 610 and the positive electrode of the fourth unidirectional device 318. The multi-stage driver module 710 can set a plurality of lighting voltages at different stages. For example, a first and a second stage lighting voltage are set according to the embodiment shown in FIGS. 3 and 4.

Figure 4:
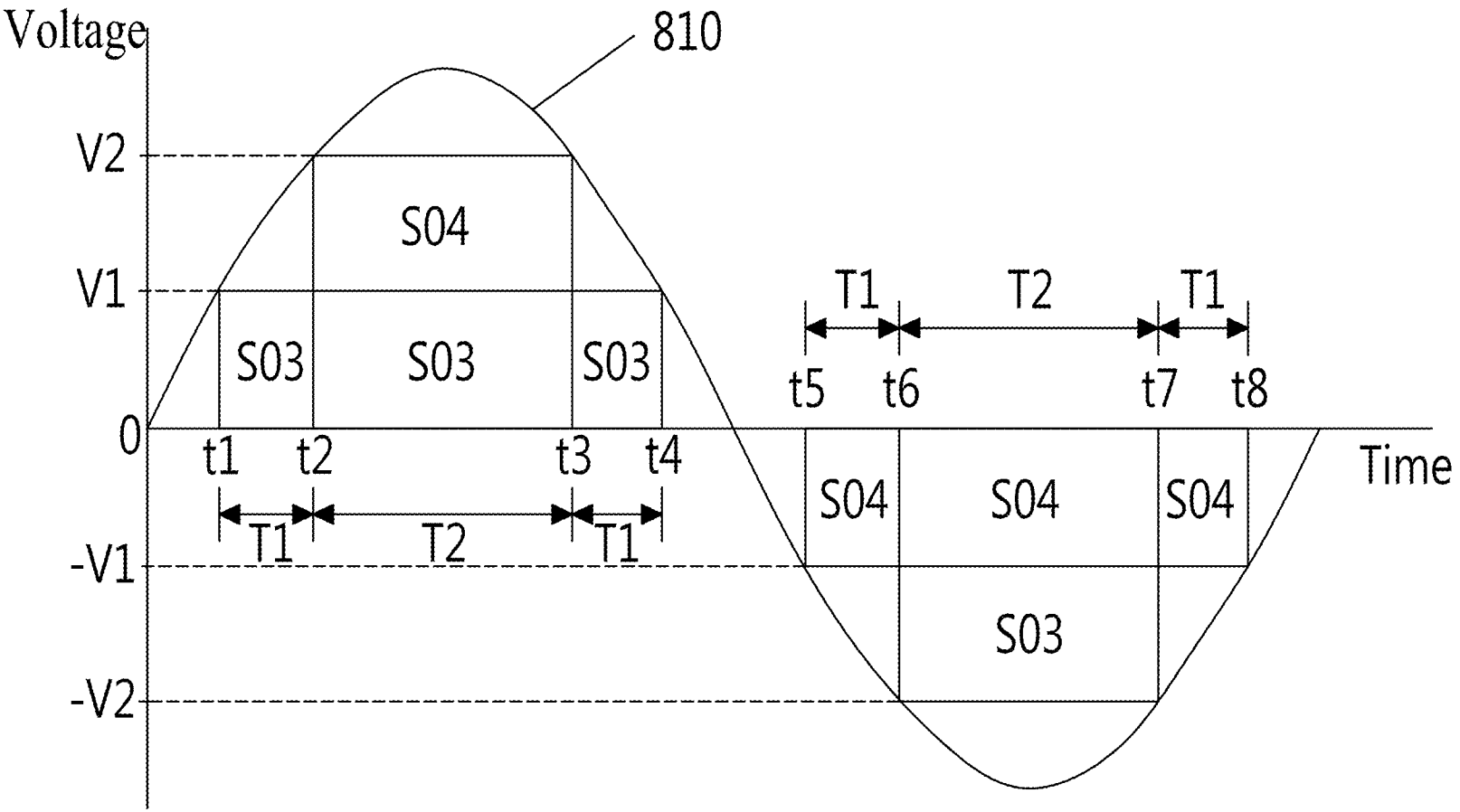
FIG. 4 shows the voltage waveform of the LED driver device in an AC power cycle according to the invention.

Referring to FIG. 4, in an AC power cycle, as the input voltage 810 increases, the first LED module 510 and the second LED module 610 are conducted sequentially and lit up one after another. When the positive half cycle or the negative half cycle is conducted, the first LED module 510 and the second LED module 610 are lit up in different alternating orders. When the positive half-cycle is conducting and the input voltage 810 increases to a level equal to the first-stage lighting voltage, the first input terminal S1 starts to operate and the LED driving current flows through the first input terminal S1. At this moment, the first LED module 510 is conducted and lit up. When the input voltage 810 continues to increase so that the voltage drop of the first input terminal S1 relative to the second input terminal S2 reaches the lighting voltage of the second stage, the LED driving current will flow through the second input terminal S2 while the first input terminal S1 will be shut off. At this moment, the first and second LED modules 510, 610 are conducted and lit up. As the input voltage 810 decreases to a level below the lighting voltage of each stage, the second LED module 610 and the first LED module 510 will no longer operate one after another. Since the flow path of the positive half-cycle is first allocated to the first LED module 510, the lighting sequence is first given to the first LED module 510 during the continuous increasing of the voltage level, followed by the second LED module 610.

In contrast, the flow path of the negative half-cycle is first allocated to the second LED module 610. When the input voltage 810 increases to a level equal to the lighting voltage of the first stage, the second input terminal S2 starts to operate and the LED current flows through the second input terminal S2. At this moment, the second LED module 610 is conducted and lit up. When the input voltage 810 continues to increase so that the voltage drop of the second input terminal S2 relative to the first input terminal S1 reaches the lighting voltage of the second stage, the LED current will flow through the first input terminal S1 while the second input terminal S2 will be shut off. At this moment, the second and the first LED modules 610, 510 are conducted and lit up. Since the flow path of the negative half-cycle is first allocated to the second LED module 610, the lighting sequence is first given to the second LED module 610 during the continuous increasing of voltage, followed by the first LED module 510.

The recitation "when the positive half cycle is conducted, the at least two LED modules are lit up in a different alternating order from the alternating order when the negative half cycle is conducted," as used herein, is intended to mean that the LED modules are conducted and lit up in different orders in the positive half cycle and the negative half cycle, as illustrated in the embodiment above. As shown in FIG. 4, the power and the brightness of the first and second LED modules are substantially identical in an AC power cycle, which can substantially overcome the problem of uneven brightness of the LED modules occurring in a conventional multi-stage driver device. According to the invention, whether the powers of the first LED module and the second LED module in an AC power cycle are substantially identical can be determined by the following formulas.

Figure 1:
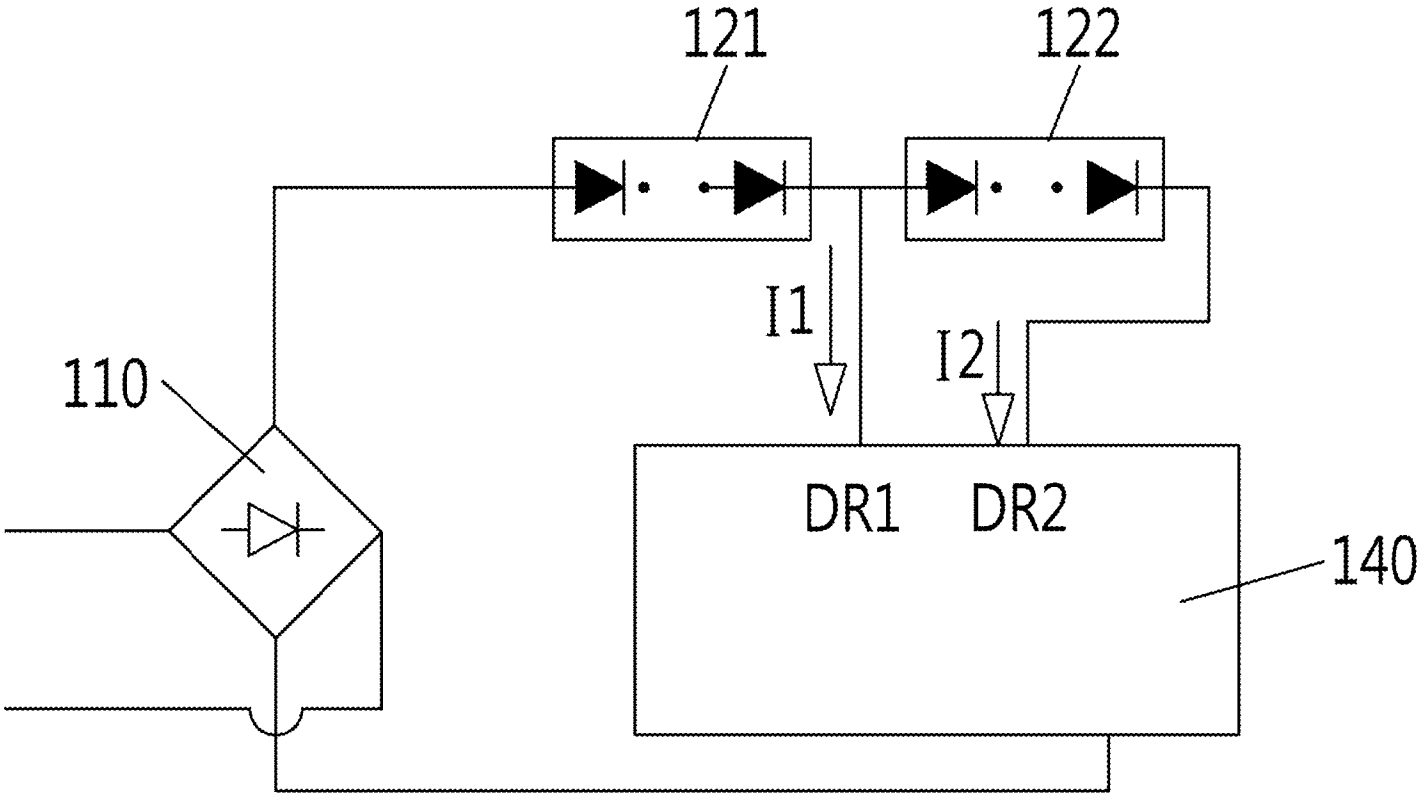
FIG.1 PRIOR ART
FIG. 1 is a schematic diagram of a conventional multi-stage linear driver.
Figure 2:
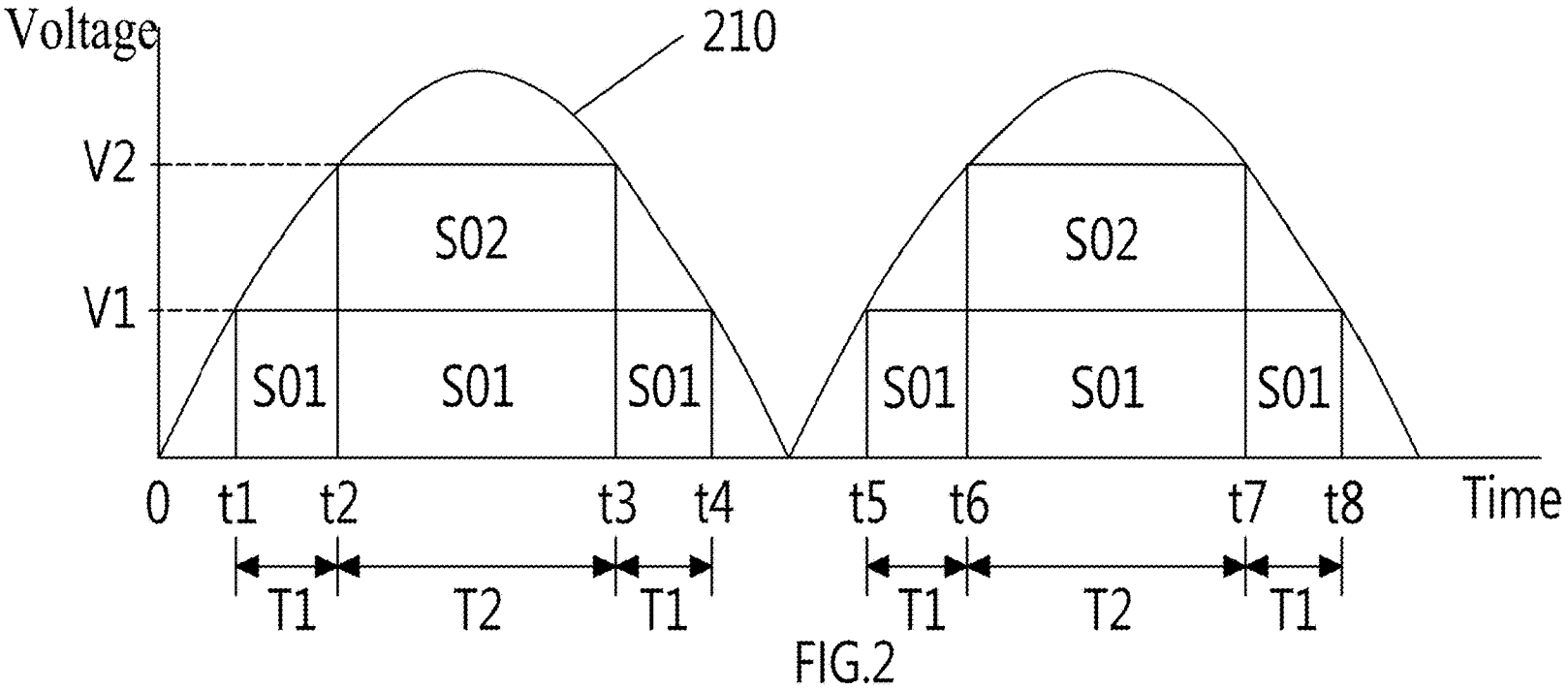
FIG.2 PRIOR ART
FIG. 2 shows the voltage waveform of a conventional multi-stage linear driver in an AC power cycle.

In FIGS. 2 and 4, V1 and −V1 represent the first-stage lighting voltages; V2 and −V2 represent the second-stage lighting voltages; the period from 0 to t1 represents the duration that the input voltage has not reached the first-stage lighting voltage; the periods from t1 to t2, from t3 to t4, from t5 to t6, and from t7 to t8 represent the duration that the input voltage has reached the first-stage lighting voltage. The durations for these periods are regarded as identical, that is, $T1=|t1-t2|=|t3-t4|=|t5-t6|=|t7-t8|$. The periods from t2 to t3 and from t6 to t7 represent the duration that the input voltage has reached the second-stage lighting voltage, and the durations for these periods are regarded as identical, that is, $T2=|t2-t3|=|t6-t7|$.

In the conventional driving circuit shown in FIG. 2, S01 and S02 represent the power of the two LED segments after being conducted and lit up in an AC power cycle, respectively; I1 is the driving current value at the lighting voltage V1, and I2 is the driving current value at the lighting voltage V2, where $$S01=I1\times V1\times 4T1+I2\times V1\times 2T2,$$

$$S02=I2\times(V2-V1)\times 2T2. \quad \text{(Equation 1)}$$

Assuming that V2=2V1, then $$S02=I2\times V1\times 2T2 \quad \text{(Equation 2)}$$

Equation 1 subtracted by Equation 2 gets (I1×V1×4T1), indicating that S01 is greater than S02, i.e., there is still a difference in power between the two LED segments 121, 122 after being conducted and lit up, resulting in a difference in brightness between the two LED segments 121, 122.

In comparison, as shown in FIG. 4, S03 and S04 represent the powers of the first and the second LED modules after being conducted and lit up in an AC power cycle, respectively; I1 is the driving current value at the lighting voltage V1, and I2 is the driving current value at the lighting voltage V2, where $$S03=I1\times V1\times 2T1+I2\times V1\times T2+I2\times(V2-V1)\times T2 \quad \text{(Equation 3)}$$

$$S04=I2\times(V2-V1)\times T2+I1\times V1\times 2T1+I2\times V1\times T2 \quad \text{(Equation 4)}$$

Equation 3 is identical to the Equation 4, indicating that S03 is equal to S04, i.e., the powers of the first and the second LED modules after being conducted and lit up are substantially identical and the brightness of the first and the second LED modules is also substantially identical, making no difference of light and dark perceived by human eyes.

Figure 5:
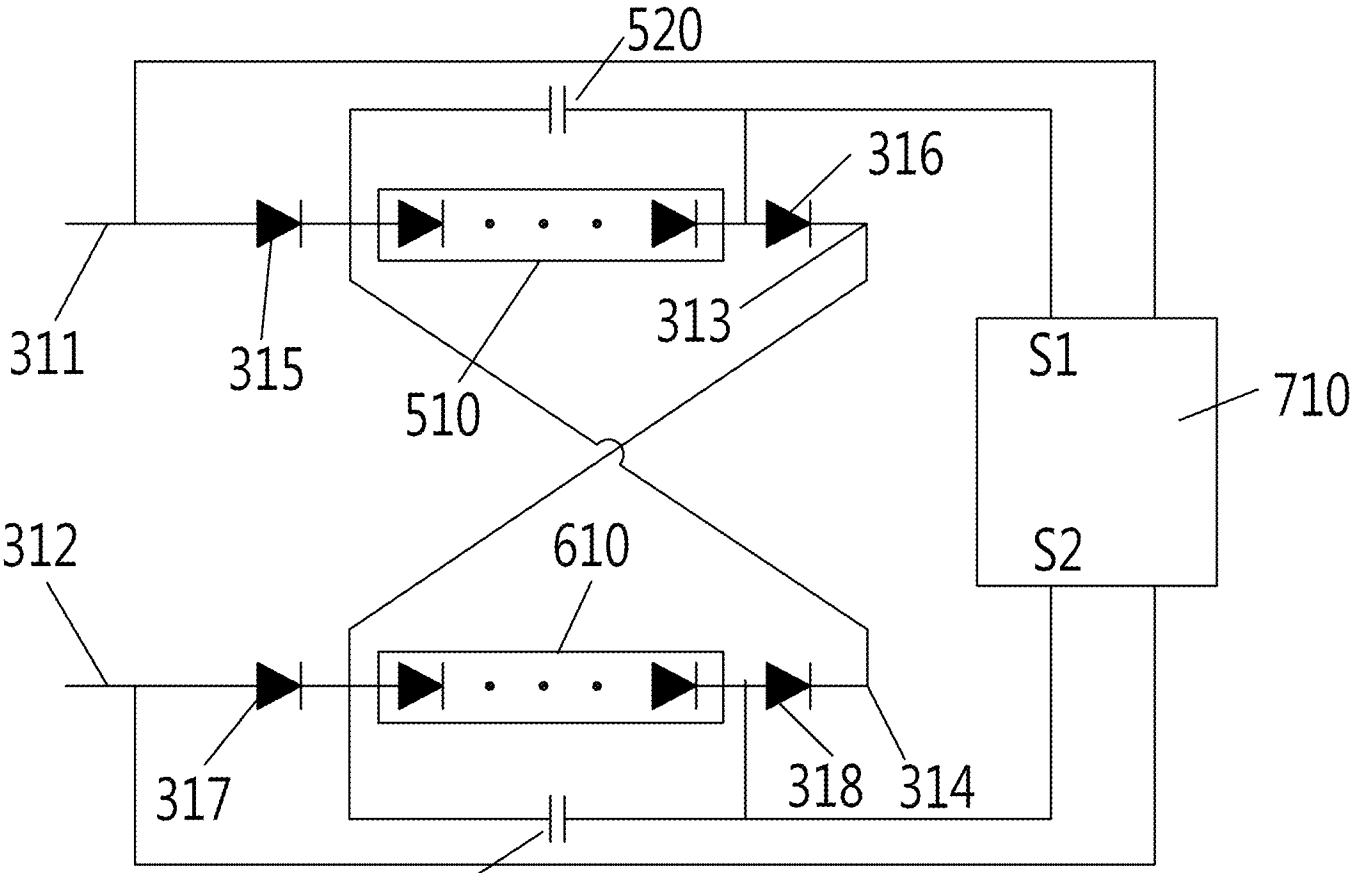
FIG. 5 is a second schematic diagram of the LED driver device according to the invention.

Furthermore, as shown in FIG. 5, the first LED module 510 is further connected in parallel with a first capacitor unit 520, and the second LED module 610 is further connected in parallel with a second capacitor unit 620, so that the first capacitor unit 520 and the second capacitor unit 620 may adjust the rectified AC output voltage to the first capacitor unit 520 and the second capacitor unit 620, respectively. During the charging phase, the rectified current drives the LEDs and charges the first and the second capacitor units 520, 620 as well. During the discharging phase, the first and the second capacitor units 520, 620 supply electric currents to the first and second LED modules 510, 610, respectively, so that the first and second LED modules 510, 610 may be in their optimal working state upon receiving DC voltages with minimal fluctuation. Not only can this improve the flicker phenomenon, but also will not affect the current harmonic wave and power factor of the LED driving circuit. In addition, the capacitor units included in the invention are connected in parallel with the LED modules, respectively. The withstand voltage values of the respective capacitor units are determined by the number of the LED modules connected to the driver device. That is to say, the more the number of the connected LED modules is, the lower the withstand voltage of each capacitor unit is, which may be lower than 100 volts. Taking the embodiment shown in FIGS. 3 and 4 as an example, low-voltage capacitors of 20~50 volts may be used, which is less costly and smaller in size.

It is known by those having ordinary skill in the art that the flicker phenomenon is varied periodically and can be defined by the variations of amplitude, average level, periodic frequency, shape, and/or duty cycle in the waveform. Typically, percent flicker and flicker index are used to quantify flicker. In order to manifest the effects of the invention further, the following data were obtained using a portable spectrometer (Model MF205N, UPRtek Co., Ltd., Taiwan) for measurement on the present invention and the conventional linear driver devices.

TABLE 1

| | Conventional single-stage linear driver | Conventional six-stage linear driver | Driver device disclosed herein |
|---|---|---|---|
| Flicker Index | 0.4 | 0.25 | 0.05 |
| Percent Flicker (%) | 99 | 99 | 17 |
| SVM | 4.1 | 2.8 | 0.5 |
| Frequency (Hz) | 120 | 120 | 120 |

TABLE 2

| | Conventional single-stage linear driver | Conventional six-stage linear driver | Driver device disclosed herein |
|---|---|---|---|
| Flicker Index | 0.68 | 0.42 | 0.06 |
| Percent Flicker (%) | 99 | 99 | 25 |
| SVM | 6.2 | 5.9 | 0.68 |
| Frequency (Hz) | 120 | 120 | 120 |

According to the data measured by the portable spectrometer, Table 1 shows the results obtained by using a TRIAC dimmer to adjust the brightness to a level of 100%, and Table 2 shows the results obtained by adjusting the brightness to a level of 20% using a dimmer. The lower the percent flicker and the flicker index, the less serious the flicker phenomenon is. Stroboscopic effect visibility measure (SVM) was further used herein to assess the visibility of high-frequency flicker, and it was determined by subjecting the measured light output waveform to fast Fourier transform at frequency range of 80 Hz~2000 Hz, sampling time at least 1 s, and the lowest sampling speed being 4000 times/s, followed by combining with the human eye's frequency response function. When SVM=1, weak visibility; SVM<1, no visibility, and SVM>1, clear visibility. It can be seen from the data shown in Tables 1 and 2 that when the brightness was adjusted by a dimmer to a level of either 100% or 20%, the device disclosed herein gives the lowest flicker index, the lowest percent flicker and the lowest SVM in either case and SVM<1. In other words, the device disclosed herein resulted in minimal flickering. Furthermore, the new lighting regulations implemented in California, USA, have promulgated new standards for the flashing of light sources when the brightness is dimmed to levels of 100% and 20%. When the light flash frequency is at values lower than 200 Hz, percent flicker must be less than 30%. According to the data demonstrated in Tables 1 and 2, only the device disclosed herein meets the new standards.

Figure 6:
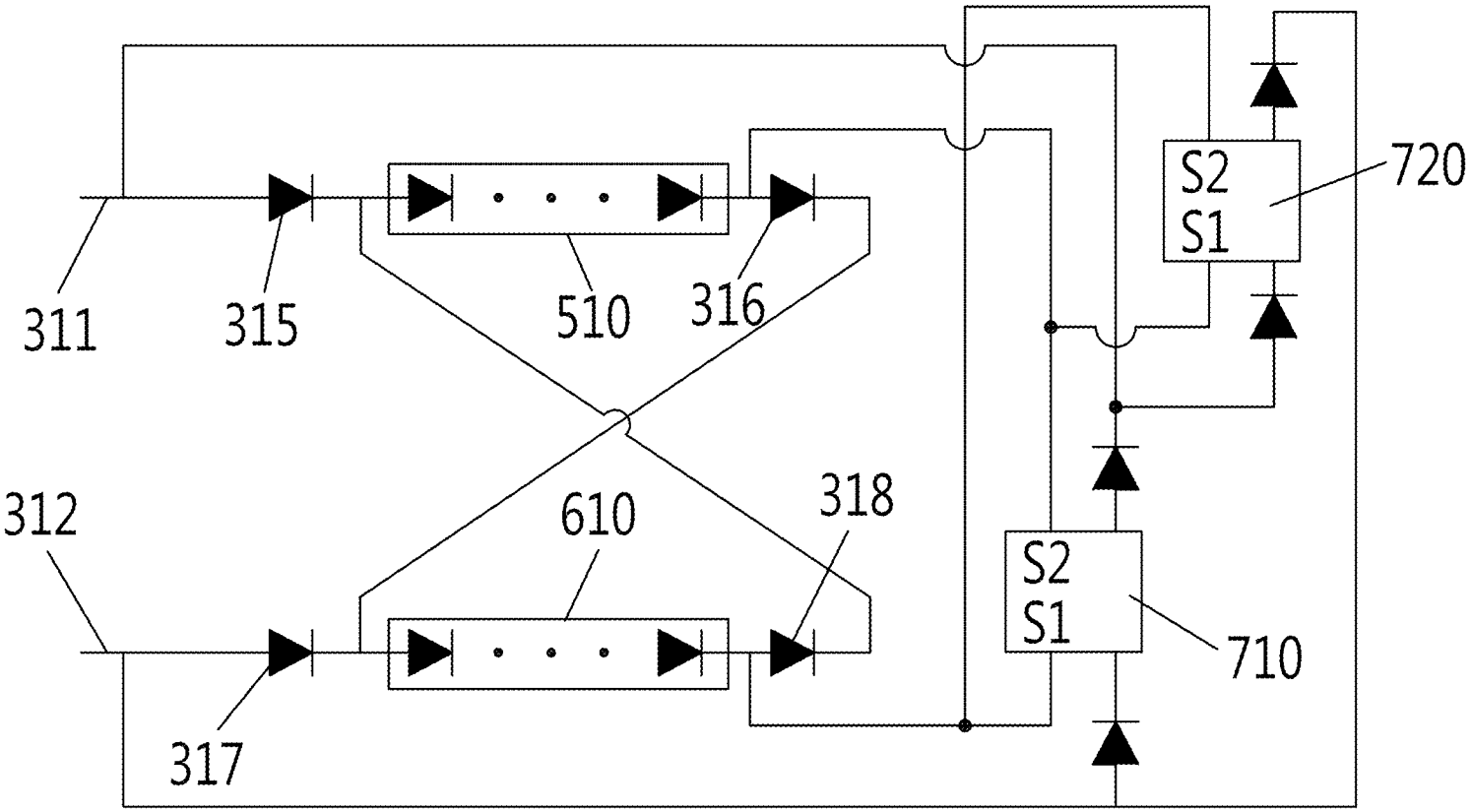
FIG. 6 is a third schematic diagram of the LED driver device according to the invention.

In addition, according to the embodiment shown in FIG. 6, the invention comprises a plurality of multi-stage driver modules. For example, the invention may comprise two multi-stage driver modules 710, 720, each having a first and a second input terminals S1, S2, wherein the first input terminal S1 of the multi-stage driver module 710 is coupled between the second LED module 610 and the positive electrode of the fourth unidirectional element 318, while the second input terminal S2 is coupled between the first LED module 510 and the positive electrode of the second unidirectional element 316. The first input terminal S1 of the multi-stage driver module 720 is coupled between the first LED module 510 and the positive electrode of the second unidirectional element 316, while the second input terminal S2 is coupled between the second LED module 610 and the positive electrode of the fourth unidirectional device 318. The driver device shown in FIG. 6 can also accomplish multi-stage driving and allow the power and brightness of the first and the second LED modules to be substantially identical in an AC power cycle.

Figure 7:
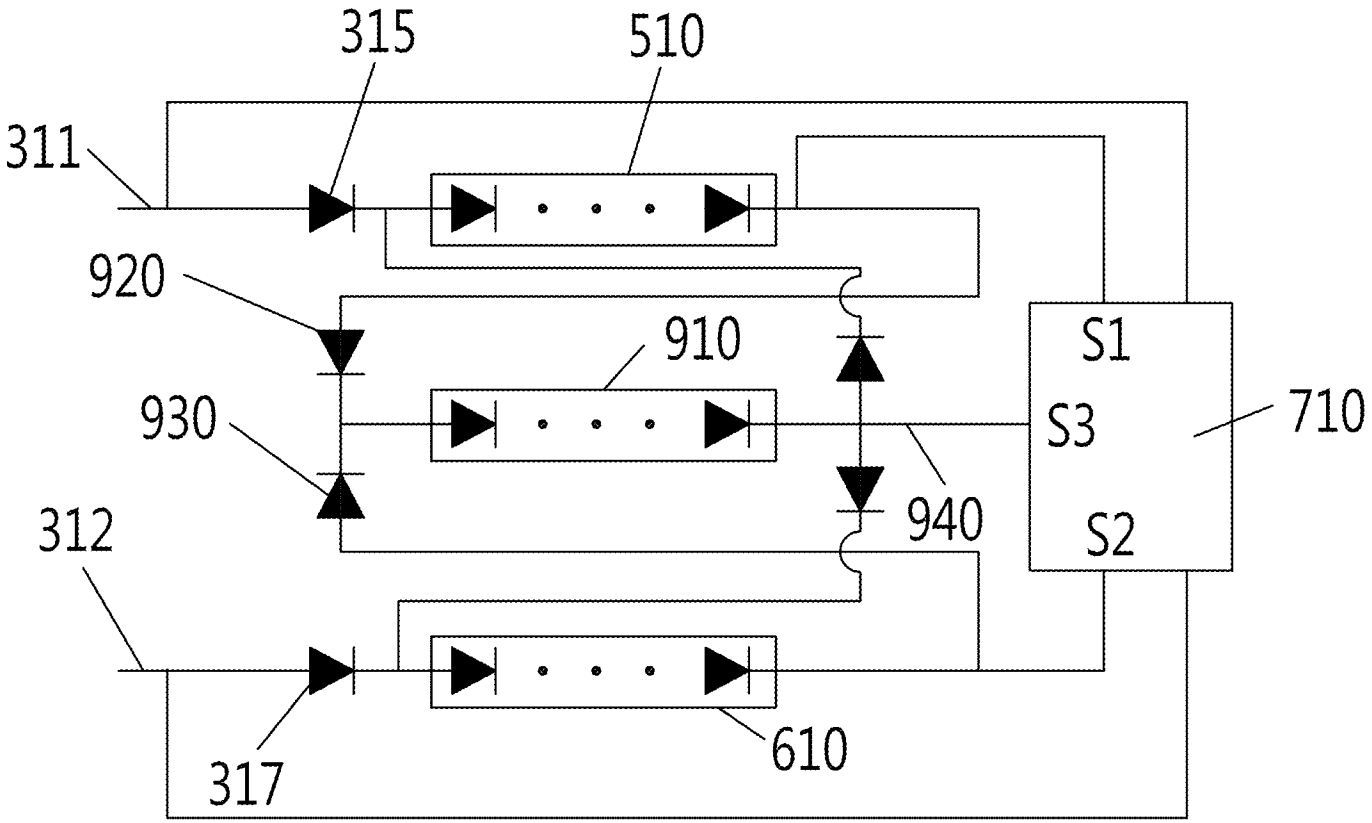
FIG. 7 is a fourth schematic diagram of the LED driver device according to the invention.

Furthermore, the invention can be further provided with at least one additional LED module and at least one additional unidirectional element. According to the embodiment shown in FIG. 7, the invention is further provided with a third LED module 910, and the rectifier circuit is further provided with two additional unidirectional elements, i.e., a fifth and a sixth unidirectional elements 920, 930, as well as a third rectification output terminal 940, while the multi-stage driver module 710 is provided with a third input terminal S3. In this embodiment, when conducted in the positive half cycle or the negative half cycle, the first, the second, and the third LED modules are lit up alternately, and the power and brightness of the respective LED modules are kept substantially the same in an AC power cycle, thereby producing no difference of light and dark perceived by human eyes.

Figure 8:
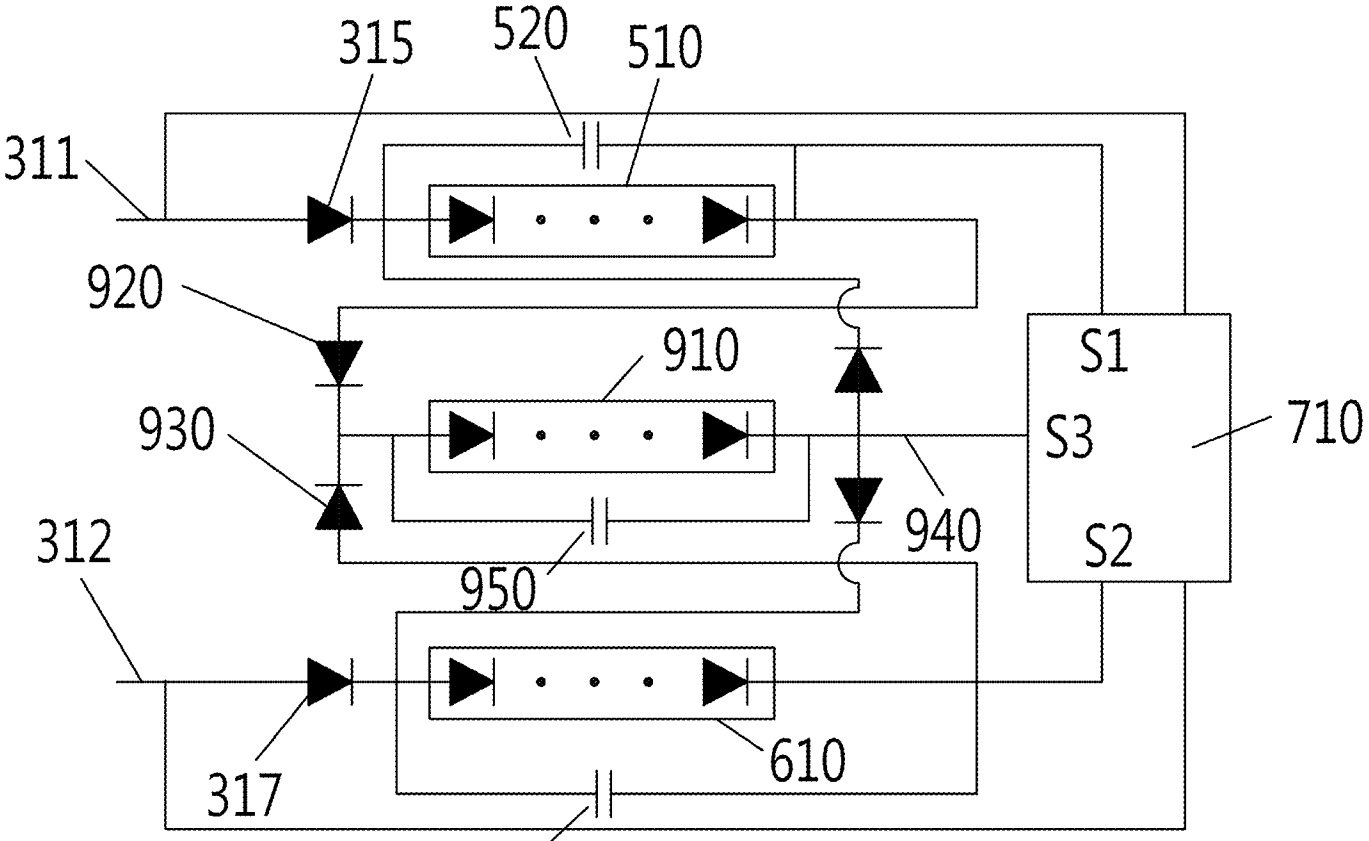
FIG. 8 is a fifth schematic diagram of the LED driver device according to the invention.

As is shown in FIG. 8, the at least one additional LED module may be further connected in parallel to an additional capacitor unit. In the embodiment shown in FIG. 8, the first, the second and the third LED modules 510, 610, 910 are connected in parallel with the first, the second and the third capacitor units 520, 620, 950, respectively. When conducted in the positive half cycle or the negative half cycle, the first, the second, and the third LED modules are lit up alternately, and the power and brightness of the respective LED modules are kept substantially the same in an AC power cycle, thereby producing no difference of light and dark perceived by human eyes. The use of the capacitor units can further diminish the flicker phenomenon, and will not affect the current harmonic wave and power factor of the LED driving circuit.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

We claim:

1. A light-emitting diode driver device, comprising:

a rectifier circuit, comprising a first and a second AC input terminals and a first and a second rectification output terminals, wherein the first and second AC input terminals are adapted to receive AC input power, and wherein the rectification circuit further comprises a first, a second, a third and a fourth unidirectional elements, each comprising a positive electrode and a negative electrode, the positive electrode of the first unidirectional element being connected to the first AC input terminal, while the positive electrode of the third unidirectional element being connected to the second AC input terminal, and the negative electrodes of the first and the fourth unidirectional elements being connected to the second rectification output terminal, and the negative electrodes of the second and the third unidirectional elements being connected to the first rectification output terminal;

a first LED module, coupled between the negative electrode of the first unidirectional element and the positive electrode of the second unidirectional element;

a second LED module, coupled between the negative electrode of the third unidirectional element and the positive electrode of the fourth unidirectional element; and a multi-stage driver module, coupled between the positive electrode of the second unidirectional element and the positive electrode of the fourth unidirectional element.

2. The device according to claim 1, wherein the multi-stage driver module comprises at least two input terminals, one of the at least two input terminals being coupled between the first LED module and the positive electrode of the second unidirectional element, while the other being coupled between the second LED module and the positive electrode of the fourth unidirectional element.

3. The device according to claim 1, wherein the multi-stage driver module is selected from the group consisting of a multi-stage driving unit and a current limiting unit.

4. The device according to claim 1, further comprising at least one additional LED module and at least one additional unidirectional element.

5. The device according to claim 4, wherein the first LED module is further connected in parallel with a first capacitor unit, and the second LED module is further connected in parallel with a second capacitor unit.

6. The device according to claim 4, wherein the at least one additional LED module is connected in parallel with an additional capacitor unit.

7. The device according to claim 6, wherein the capacitor units each has a withstand voltage value of less than 100 volts.

8. The device according to claim 4, wherein the unidirectional elements are independently selected from the group consisting of a rectifying diode or a light emitting diode.

9. A method for driving light-emitting diodes, comprising the steps of:

providing a flow path for a positive half cycle of AC power input and a flow path for a negative half cycle of the AC power input by using at least two unidirectional elements, respectively;

integrating at least two LED modules into the flow paths of the positive half cycle and the negative half cycle, respectively; and integrating a multi-stage driver module, so that when the positive half cycle is conducted, the at least two LED modules are lit up in a different alternating order from the alternating order when the negative half cycle is conducted.

10. The method according to claim 9, wherein the method is performed by a driver device, wherein the driver device comprises:

a rectifier circuit, comprising a first and a second AC input terminals and a first and a second rectification output terminals, wherein the first and second AC input terminals are adapted to receive AC input power, and wherein the rectification circuit further comprises a first, a second, a third and a fourth unidirectional elements, each comprising a positive electrode and a negative electrode, the positive electrode of the first unidirectional element being connected to the first AC input terminal, while the positive electrode of the third unidirectional element being connected to the second AC input terminal, and the negative electrodes of the first and the fourth unidirectional elements being connected to the second rectification output terminal, and the negative electrodes of the second and the third unidirectional elements being connected to the first rectification output terminal;

a first LED module, coupled between the negative electrode of the first unidirectional element and the positive electrode of the second unidirectional element;

a second LED module, coupled between the negative electrode of the third unidirectional element and the positive electrode of the fourth unidirectional element; and a multi-stage driver module, coupled between the positive electrode of the second unidirectional element and the positive electrode of the fourth unidirectional element.

11. The method according to claim 10, wherein the multi-stage driver module comprises at least two input terminals, one of the at least two input terminals being coupled between the first LED module and the positive electrode of the second unidirectional element, while the other being coupled between the second LED module and the positive electrode of the fourth unidirectional element.

12. The method according to claim 11, wherein the first LED module is further connected in parallel with a first capacitor unit, and the second LED module is further connected in parallel with a second capacitor unit.

* * * * *